United States Patent [19]

Nielsen

[11] 4,387,855

[45] Jun. 14, 1983

[54] SALT AND/OR GRAVEL SPREADER

[76] Inventor: Niels J. O. Nielsen, Karolinegade 6, DK-6000 Kolding, Denmark

[21] Appl. No.: 233,088

[22] Filed: Feb. 10, 1981

Related U.S. Application Data

[63] Continuation-in-part of Ser. No. 943,776, Sep. 20, 1978, abandoned.

[30] Foreign Application Priority Data

Oct. 11, 1977 [DK] Denmark ..... 4498/77
Feb. 13, 1978 [DK] Denmark ..... 648/78

[51] Int. Cl.[3] ..... A01C 3/06
[52] U.S. Cl. ..... 239/659
[58] Field of Search ..... 239/659, 3; 291/28, 291/30; 222/162, 163, 613, 614, 619

[56] References Cited

U.S. PATENT DOCUMENTS

| | | | |
|---|---|---|---|
| 44,241 | 9/1864 | Van Strum | 239/659 |
| 1,690,090 | 10/1928 | Hendricks | 239/659 |
| 1,833,989 | 12/1931 | Debnam et al. | 239/659 |
| 2,152,259 | 3/1939 | Humphrey | 239/659 |

FOREIGN PATENT DOCUMENTS

| | | | |
|---|---|---|---|
| 689013 | 6/1964 | Canada | 239/659 |
| 663834 | 11/1928 | France | 239/659 |
| 199011 | 10/1965 | Sweden | 291/30 |

*Primary Examiner*—John J. Love
*Assistant Examiner*—Gene A. Church
*Attorney, Agent, or Firm*—Holman & Stern

[57] ABSTRACT

A salt and/or gravel spreader comprising a mobile container or hopper constructed to have two bottom walls, transverse to the direction of travel, inclined downwards towards an oblong slot at which is mounted a mechanism for the discharge of salt and/or gravel. The lower part of one of the inclined bottom walls has at least one pivotally mounted slat protruding beneath the other inclined bottom wall. Below one or all the pivotal slats is situated a rotatable shaft having a cam for each slat, whereby the slat(s) at the free end through the rotation by the shaft of the cam(s) will swing towards or away from the edge of the other inclined bottom wall. The spreader cannot be blocked by the spreading material and easy adjustment of the dosing can be performed during operation.

12 Claims, 4 Drawing Figures

SALT AND/OR GRAVEL SPREADER

BACKGROUND OF THE INVENTION

This application is a continuation-in-part of Application Ser. No. 943,776, filed Sept. 20, 1978 now abandoned, the subject matter of which is incorporated herein by reference.

FIELD OF THE INVENTION

The invention relates to a road salt and/or gravel spreader comprising in one embodiment a wheeled container such as a mobile hopper having two spaced side walls and front and rear bottom walls transverse to the direction of travel, between the side walls which slope downwardly towards each other and an ablong slot at which is mounted a mechanism for the discharge of salt and/or gravel contained within the trailer.

DESCRIPTION OF THE PRIOR ART

From the specifications to Danish Pat. No. 90 710 and corresponding Canadian Pat. No. 689013, it is known that such discharge mechanisms may be a drum made to turn when the carriage is travelling and being provided with a number of projections interacting with a resilient plate abutting the drum in such a manner that the plate is raised periodically off the drum and thereby opens a discharge slot for the material placed in the container.

A similar design is known from the specification to Danish Pat. No. 103 478 in which an eccentrically mounted drum activates a riddle functioning grate pivotably fixed to one of the inclined container walls above the slot.

Such known spreaders utilizing a drum do not function entirely satisfactory because the spreading material may stick to the drum and thus prevent an accurate dosing or spreading of the material. Another drawback of these known spreaders is that adjustment of the dosing, made by replacement of the operating cams, may be so complicated and time-consuming that it cannot be done during operation.

BRIEF SUMMARY OF THE INVENTION

It is an object of the invention to provide a salt and/or gravel spreader avoiding the above drawbacks, i.e. a spreader which cannot be blocked by the spreading material, and which allows an easy adjustment of the dosing during operation.

This is achieved according to the invention by the lower part of one of the sloping container walls being made up of one or several pivotably mounted slats protruding below the inclined container wall or walls, and below one or all the pivotable slats is situated a revolvable shaft carrying a cam for each slat, whereby the slat(s) at the free end(s) through the rotation of the cam(s) will swing towards or away from the adjacent edge of the other inclined container wall.

There are in the construction of the invention, no rotating members within the spreading material, and the dosing may be adjusted by changing the position of the other inclined container wall to regulate the maximum slot width.

In the case of several adjacent slats according to the invention, the cams on the revolvable shaft are mutually staggered along the circumference of the shaft to ensure that the spreading material is not dispersed in cross-wise strips.

If the spreading material is very small-grained, it is according to the invention, advantageous that near to the free edge of the slat(s) is provided under the other inclining container wall, a protruding stop plate. From the slot the spreading material will drop down onto the said stop plate and remain there until swept over the edge of the plate by the slat(s) during the movement towards the other inclined container wall.

The dosing may, as mentioned, be regulated by displacement of the other inclining container wall, but such displacement may be difficult where the wall is carrying the spreading material. A simple regulation of the dosing may, according to the invention, be achieved by providing below the pivotable slat(s), a hand revolvable shaft on which is a cam for each slat, by which the movement of the slat(s) away from the other inclined container wall may be limited.

In spreading salt, it may be difficult to attain the desired even distribution when the salt is moist and thereby tends to conglomorate into lumps of varying sizes accumulating in the spreader behind the stop plate. Especially for the spreading of road salt or fertilizers, it is desirable that the material be distributed as evenly as possible and therefor that the lumps be crushed before dispersal.

To alleviate this inconvenience, according to the invention, one or several movable scrapers are mounted on the other inclined container wall and the free edge of each passes parallel with the free upper edge of the stop plate. This ensures that the spreading material will be discharged from the spreader in an even flow, as all lumps will be crushed by the movable scrapers. The spreader can thus be adjusted to a desired discharge rate and will remain in the adjusted position even when the grain size or consistency of the material to be spread may change for instance, by absorption of moisture. This makes it unnecessary to overdose to secure an adequate spreading, which is otherwise required when the material tends to clot.

Also, according to the invention, there may be attached to the free end surface of the scraper a resilient plate. The said plate may ensure a complete crushing of occurring lumps. The disintegration is further improved by the end surface concerned alternatively being provided with holes.

Spreading on steep gradients or otherwhere may require spreading during reverse travelling. This is according to the invention, advantageous in that the scraper shaft both by forward and by reverse motion, will rotate synchronously with the cam shaft. This is achieved in different manners, e.g. by one of the shafts being provided with an idling phase, which in reverse travelling, turns the shaft in the direction opposite to its turning directon during forward travel and will outphase the cams on either shaft by a 90 degree displacement of the shaft concerned.

BRIEF DESCRIPTION OF THE SEVERAL VIEWS OF THE DRAWING

The invention will be described in detail below with reference to the drawings in which.

DETAILED DESCRIPTION

The salt and/or gravel spreader of this invention is preferably incorporated in a mobile container or hopper, the chassis and road wheels of which are shown schematically.

Figure 1:
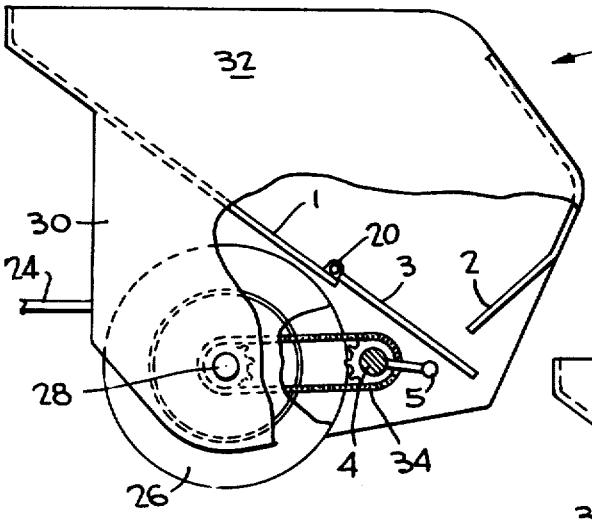
FIG. 1 shows an elevation view of a mobile hopper partly in section and with parts cut away to illustrate the main parts of a spreader according to the invention.
Figure 2:
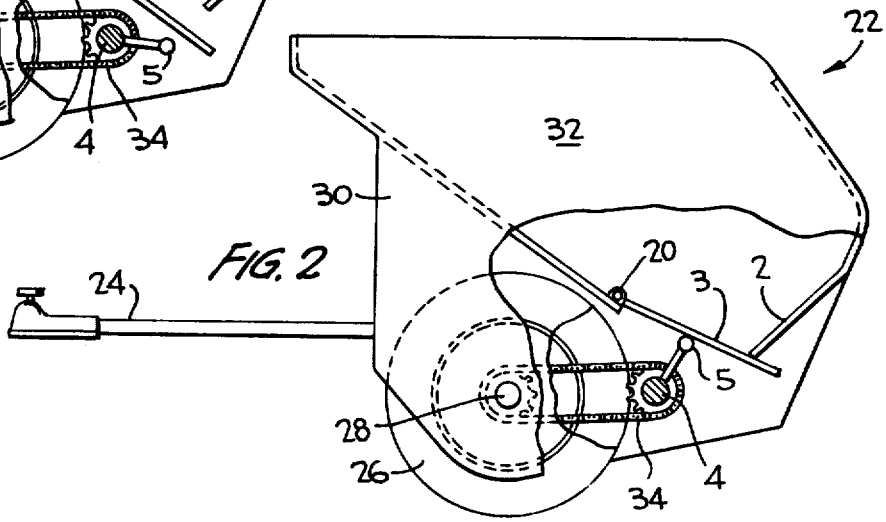
FIG. 2 is a view similar to FIG. 1, but showing parts of the spreader in a different position.

The container or hopper 22 is a conventional type having sides and a bottom and can be self propelled or constructed to be towed by a lorry or truck, e.g. in which case a tongue 24 may be provided on the chassis for connection to a hitch or drawbar. The hopper has rotatably mounted thereon wheels 26 which in the embodiment shown in FIGS. 1 and 2 are mounted on an axle 28 which may be rotatably supported at its ends in bearings (not shown) mounted in lower extensions 30 of the side walls 32 of the hopper. The bottom of the hopper is comprised of front and rear walls 1 and 2, respectively, which at their lower portions are inclined downwardly in a converging manner with respect to each other and their lower edges are spaced apart to provide a slot therebetween. The walls 1 and 2 extend the width of the hopper generally transversely to the direction of travel and are connected at their side edges to the inner surfaces of the side walls 32 such as by welding, for example. The slot in this embodiment also extends the full width substantially of the hopper which is filled from the top and discharges through the slot.

At or near the lower edge of wall 1 one, or several adjacent pivotable slat(s) 3 are pivotably mounted at 20 and extend below the other inclined wall 2. Below the slat 3 is situated a rotatable shaft 4, on which is mounted a cam 5 for each slat 3 which engages each slat during part of its revolution, so that the salt 3 will swing towards and away from the other inclined wall 2 about pivot 20. Shaft 4 is journalled at its ends in any well known manner such as, for example, in the side walls of the hopper, not shown. Shaft 4 is driven by axle 28 through a suitable interconnecting drive means such as a chain and sprocket drive unit 34, for example.

Figure 3:
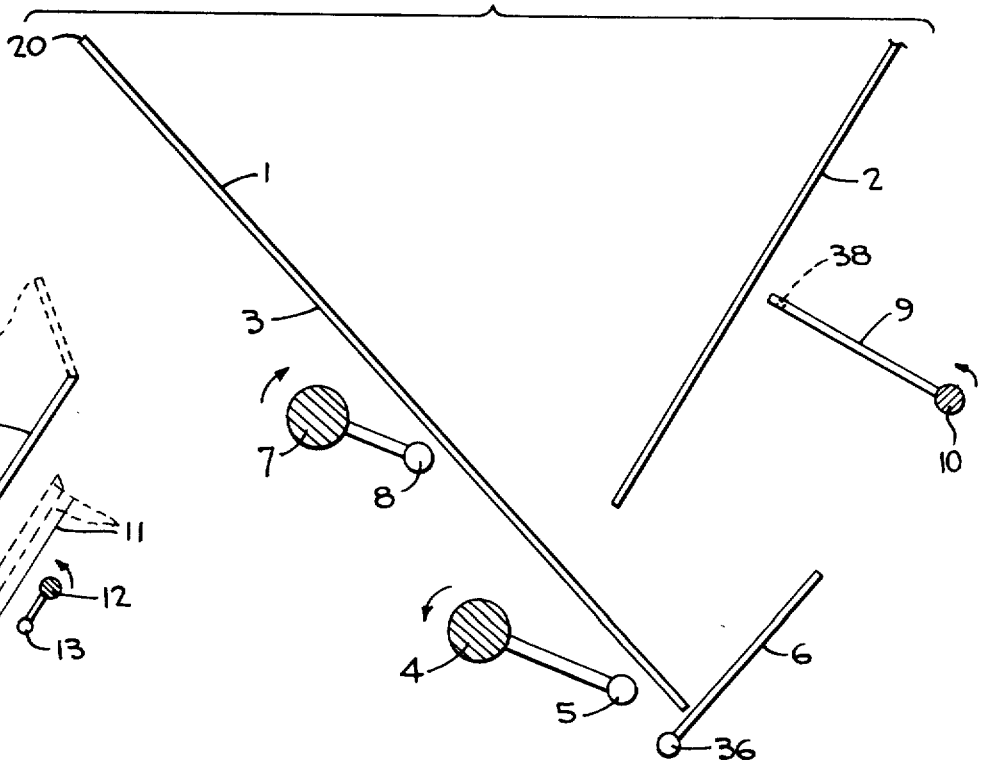
FIG. 3 is a schematic vertical cross-section through the spreader.

In the embodiment of FIG. 3, adjacent the lower edge of slat 3 is situated a stop plate 6 protruding under the inclined wall 2. The stop plate 6 is pivotably or displaceably (cf. FIG. 2) mounted so that it may be moved from positions, in which at least part of the plate 6 is below the slot between the walls 1 and 2, to a position in which the plate 6 does not obstruct the flow of material to be discharged through the slot. As shown in FIG. 3, stop plate 6 is pivotally mounted on shaft 36 which may be journalled at its ends in the lower portion 30 of side walls 32 and it position may be adjusted by a handle (not shown) in any well known manner. Below the pivotable slat 3 is situated another rotatable shaft 7 journalled in the same manner as shaft 4 (not shown) on which is mounted a cam 8 for each slate 3. A handle (not shown) is provided to rotate shaft 7 in any well known manner. By manual turning of this shaft 7, the cams 8 can be made to engage slat 3 to move each one towards or away from the inclined wall 2, whereby the slot is closed, or partially opened to regulate the quantity of material to be discharged, as required. Below the other inclined wall 2 is mounted one, or several, movable scrapers. In the embodiment shown in FIG. 3, each scraper is made up of a plate 9 carried by a rotatable shaft 10 and radially extending therefrom. Shaft 10 is parallel with the cam shaft 4 and is journalled at its ends in a similar well known manner (not shown).

Figure 4:
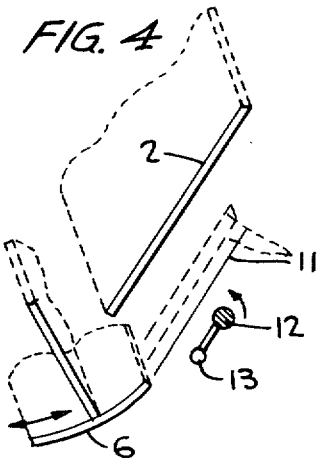
FIG. 4 is a schematic vertical cross-section similar to FIG. 3 but showing another embodiment of the spreader of this invention.

In the embodiment shown in FIG. 4, the scrapers are made up of one or several resilient slats 11, suitably mounted on the frame of the container (not shown), below which is situated a rotating shaft 12 parallel with the cam shaft 4, and suitably journalled in a manner similar to shafts 4, 7 and 10 (not shown). The shaft 12 carries for each slat 11, a cam 13 in a manner such that each cam will engage each slat 11 during part of its revolution, by the rotation of the shaft 12 to move each slat 11 forwards and backwards from the free edge of the stop plate 6 and inwards towards the inclined wall 2 of the container. The shafts 10 and 12 are driven by any suitable means such as a chain and sprocket drive means interconnecting these shafts with axle 28 in the manner shown in FIG. 1 for shaft 4.

The spreader functions in the following manner:

With the shaft 7 turned to the position in which cam 8 moves the slat(s) 3 to close the slot between the bottom walls 1 and 2, the container is filled with the material to be discharged. When the shaft 7 is turned again to remove cam 8, slat 3 will lower and open the slot through which the material will pass and slide down the container walls until stopped by the stop plate 6.

When the cam shaft 4 is made to rotate, the slat(s) 3 will be intermittently raised by cam 5 towards the inclined wall 2, and the material resting on the stop plate will be lifted over the edge of the stop plate. When thereafter, the slat(s) 3 is moved away from the inclined wall 2, a new portion of material of a quantity determined by the position of the manually operated shaft 7 will drop down on the stop plate 6. If the material tends to lump, e.g. road salt, the scrapers 9 or 11 will serve to crush lumps accumulating behind the stop plate 6.

For emptying and cleaning of the spreader, the shaft 7 is turned manually to a position in which the slot between the bottom walls 1 and 2 is at a maximum, and the stop plate 6 is swung or displaced away from the shown position, in such a manner that the container bottom is wholly opened.

For the sake of completeness, it should be noted that the rotatable shafts 4, 7, and 10 may be mounted for rotation in well known manner and driven by means of a declutchable transmission mechanism operatively connected with the axle supporting the wheels of the spreader. The transmission mechanism can be constructed in different ways, all well known to a person familiar with the art and is not intended to be a part of the invention and accordingly is not shown.

The free end of scraper 9 may be provided with a plurality of speced holes 38 to aid in the operation of the scraper.

I claim:

1. Salt and/or gravel spreader comprising a container having side walls and two oppositely situated bottom walls transverse to the direction of travel inclined downwards towards an oblong slot defined between the lower ends of said walls, and a mechanism for discharging salt and/or gravel through said slot comprising at least one slat pivotably mounted on the lower part of one of said inclined bottom walls as an extension thereof protruding below the other inclined bottom wall, a rotatable shaft rotatably mounted on said container below said slat, a cam for each slat mounted on said shaft to revolve therewith to engage said slat during part of its revolution to move said slat in an oscillating motion into and away from engagement with the lower edge of said other inclined bottom wall to respectively close and open said slot, and means to rotate said shaft.

2. Salt and/or gravel spreader according to claim 1, wherein a plurality of said slats are provided adjacent to each other on said lower part of one of said bottom wells, and a plurality of said cams are provided, one for each slat, on said rotatable shaft in mutually staggered relationship around the circumference of the shaft to operate said slats intermittently.

3. Spreader according to claim 1 or 2, wherein a protruding stop plate is provided adjacent the free edge of each slat in cooperative relationship therewith and extending below said other inclined bottom wall to collect material from said container so that each slat pushes material collected on the upper surface of said stop plate over the upper edge thereof.

4. Spreader according to claim 3, and further comprising a second rotatable shaft rotatably mounted below each slat, a second cam for each said slat mounted on said second shaft to engage each slat, and means to rotate said second shaft to position each second cam to limit the opening of said slat.

5. Spreader according to claim 2, wherein below said other inclined bottom wall is mounted at least one movable scraper, the free edge of which passes substantially parallel to and in close proximity with the free upper edge of said stop plate.

6. Spreader according to claim 5, wherein said scraper comprises at least one plate member mounted on and radially protruding from a third rotatable shaft with the free edge thereof above said stop plate.

7. Spreader according to claim 6, wherein a plurality of radially protruding plates are provided in a helical line on said third shaft.

8. Spreader according to claim 5, wherein said scraper comprises at least one resilient slat mounted on the container below which is rotatably mounted another shaft, a cam for each resilient slat mounted on said another shaft adapted to engage each resilient slat during part of its revolution, said another shaft interacting with the first rotatable shaft in such a manner that each resilient slat is moved forwards and backwards from the free edge of the respective stop plate and inwards towards said other inclined bottom wall when the shafts are rotated.

9. Spreader according to claim 8, having a plurality of adjacent resilient slats, wherein said cams of the said another shaft are mutually staggered along the circumference of the shaft.

10. Spreader according to claim 5, wherein a resilient plate is fastened to the free end surface of the scraper.

11. Spreader according to claim 5, wherein the free end surface of the scraper is provided with holes.

12. Spreader according to claim 6, wherein said third shaft rotates synchronously with said first mentioned shaft in either forward or reverse travel of the spreader.

* * * * *